United States Patent [19]

Schubert et al.

[11] Patent Number: 4,569,070

[45] Date of Patent: Feb. 4, 1986

[54] THERMALLY COMPENSATED X-RAY TUBE BEARINGS

[75] Inventors: Thomas E. Schubert, Pewaukee, Wis.; John C. Clark, Oxford, Ohio

[73] Assignee: General Electric Company, Schenectady, N.Y.

[21] Appl. No.: 533,769

[22] Filed: Sep. 19, 1983

[51] Int. Cl.[4] ..... H01J 35/10; H01J 35/24; H01J 35/26; H01J 35/28

[52] U.S. Cl. ..... 378/132; 378/125

[58] Field of Search ..... 378/132, 125, 133

[56] References Cited

U.S. PATENT DOCUMENTS 2,648,025 8/1953 Agule ..... 378/132

4,272,696 6/1981 Stroble et al. ..... 378/132

*Primary Examiner*—Alfred E. Smith

*Assistant Examiner*—T. N. Grigsby

*Attorney, Agent, or Firm*—Fuller, House & Hohenfeldt

[57] ABSTRACT

The rotor that carries the target in a rotating anode x-ray tube is carried on a shaft that is journaled in axially spaced apart ball bearings. The outer and inner races of the bearings have curved grooves presented toward each other and there are a plurality of balls in the grooves. A preloaded spring is interposed between corresponding races of the bearings for applying oppositely directed axial forces to them. The grooves are so shaped and the clearance between the balls and groove surfaces is such that when the axial force is applied, one race shifts axially relative to the other in which case each ball has two points of contact, one point at which the ball contacts the surface of the groove in the outer race on one side of a plane transverse to the shaft axis and another point where the ball contacts the surface of the groove in the inner race on the other side of the plane. The chosen axial preload force is in a range of forces that compels many balls to share the radial load of the rotor and target to minimize contact stress on each ball and the races and the preload spring force range begins just above the force that would result in one or a few of the balls carrying the radial load.

7 Claims, 7 Drawing Figures

THERMALLY COMPENSATED X-RAY TUBE BEARINGS

BACKGROUND OF THE INVENTION

This invention relates to rotating anode x-ray tubes wherein the target and anode assembly rotate in ball bearings at high speed.

There are two basic types of rotating anode x-ray tubes insofar as arrangement of the structural components is concerned. In the first type, which is the type used for illustration herein, a metal sleeve is mounted in a vacuum tight fashion in the x-ray tube envelope and one end of the sleeve extends from the envelope for allowing an external electrical connection to be made to it. The outer races of two axially spaced apart ball bearings are mounted in opposite ends of the sleeve. A shaft is supported at its opposite ends in the inner races of the axially spaced apart bearings. An outer sleeve that is concentric with earlier mentioned sleeve and constitutes the rotor of an induction motor is provided with an axially extending stem on which the x-ray tube target is fastened. The outer rotating sleeve is usually coated with a material that has high heat emissivity to dissipate as much as possible of the heat that is developed in the target as a result of the electron beam of the tube striking the target for the purpose of generating x radiation. A substantial amount of heat is conducted through the bearings so that under expected operating conditions bearing temperatures may be on the order of 500° C. The inner and outer races of the bearings and the balls are coated with silver which constitutes the lubricant for use in the high vacuum and high temperature environment that exists in an x-ray tube for a normal operation. For some x-ray protocols the anode and target only have to be rotated at around 3600 rpm to avoid melting of the target at the x-ray beam focal spot and for other protocols where higher x-ray tube currents and voltages are used, the target is customarily rotated at about 10,000 rpm. Typically, the rotor is driven as a two-pole induction motor so that 50 or 60 Hz is applied to the field coils for the lower speed and 180 Hz is applied for the higher speed. In foreign countries, the frequencies might be 50 Hz and 150 Hz, respectively.

A second type of rotating anode x-ray tube is the structural converse of the first one. In the second type, instead of having a rotating shaft, the shaft is fixed. There are axially spaced apart bearings on the shaft. A sleeve which has the stem extending from it and that supports the target, fits tightly on the outer races of the bearings so it is the outer races that turn rather than the inner races as in the first case. In the second case, as in the first, the bearings act as thermal conductors and as conductors of electricity as well.

In both types of tubes, the front ball bearing, that is, the bearing nearest to the target is loaded radially and in cantilever fashion by the heavy target suspended at the end of the stem. The center of gravity is invariably between the front bearing and target somewhere along the stem so the radial load on the front bearing is greater than that on the rear bearing which is axially displaced from the front bearing. The radial reactive forces on the front and rear bearings are opposite of each other in both types of rotating anode x-ray tubes.

All modern prior art heavy duty rotating anode x-ray tubes of which applicants are aware use the same kind of ball bearings which differ from bearings used in the invention described herein. Typically, the outer race of the prior art ball bearings is either flat or has an angular groove whose cross-section constitutes a segment of a circle in which the balls run. The inner race has an angular groove that is basically v-shaped in cross-section. More specifically, the inner race groove has a cross-section that is more analogous to a modified gothic arch. The arch configuration is similar to what would be obtained if an inner-race ring had a groove machined in it that coincided in cross-section with an arc or segment of a circle. Then, by doing the equivalent of sawing the ring in half and removing some material between the two ring sections that remained and then pushing the sections into interfacing relationship a more nearly v-shaped or gothic arch shaped groove will result. In reality, of course, the groove is formed in a single machining operation. When this prior art bearing is assembled, the balls make 3-point contact with the races. Two points of contact are made where the ball is tangential to the slanted grooves in the halves of the inner race and one contact point is made between the balls and the outer race. In anticipation of the high temperatures at which the x-ray tube will operate, a certain amount of clearance has been provided between the balls and races to account for the fact that races and balls will expand substantially as a result of becoming hot during use of the tube. If no clearance were allowed, the bearings would seize rather quickly when they got hot. Moreover, if clearance is too small any silver particle that flakes off of the rolling surfaces of the bearings or balls can wedge between the balls and races and freeze the bearing. On the other hand, if the clearance is too great the bearing may run noisily and the target may wobble so as to oscillate the focal spot of the tube which militates agains obtaining sharp radiographs. There are two other disadvantages to trying to avoid bearing seizure by using a substantial amount of clearance between balls and races. One disadvantage is that the balls are more free to bounce in which case, since they are conducting electricity, there will be sparking between the balls and races which will result in their roughening and premature failure. Another disadvantage of excessive clearance between the balls and races is that the cantilever loaded shaft or sleeve that rotates will exhibit excessive deflection which ultimately results in only one ball at a time in the front bearing being radially loaded and a diametrically opposite ball in the rear bearing being radially loaded at the same time. Hence, the one ball in each bearing that is loaded at any moment is subjected to excessive stresses which will cause it to fatigue and cause premature bearing failure. An ideal bearing is one in which all of the balls accept or share the radial load equally at all operating temperatures and all angles of rotation of the x-ray tube rotor. This has never been achieved in an x-ray tube before the invention described herein was made insofar as applicants are aware.

The stratagem used in the x-ray tube described herein to obtain more uniform load sharing by the ball bearings is to actually, in a sense, increase the loading on them by applying a substantial axially directed force on the bearing races and, thus, to the balls.

Pseudo-axial preloading of ball bearings in a rotating anode x-ray tube has been done heretofore as in U.S. Pat. No. 4,272,696 which is assigned to the assignee of the present application. The objective of the inventors in the patent was to keep the bearing balls in contact with the surfaces of the grooves in races to avoid sparking that would occur between the balls and races and which was thought to roughen the bearings and cause premature failure. The approach in the prior patent was to apply an axial load to corresponding races on the front and rear bearings to thereby press the balls axially and force them to make good contact with the other races. The axial force was obtained by disposing a coil type prestressed compression spring made of molybdenum between corresponding races. Conventional three contact point bearings were, of course, used. These bearings had a total clearance of about 0.0015" between the balls and races. The life of the bearings was, however, not extended as much as what was expected. Hence, the axial loading spring was redesigned to raise the axial force from 1.5 lbs. to 3 lbs. Since there was 3-point ball contact and a greater axial load, bearing friction simply increased and the bearings got hotter and expanded and ultimately froze. The conclusion was that in the particular x-ray tube design, given bearings and shaft of a certain size, the axial force had to be under 3 lbs. Yet at this lower level of axial loading, the disadvantage of having one ball in each bearing carrying most or all of the radial load was not overcome.

Rotating anode x-ray tubes are regularly used in computed tomography apparatus. The targets in x-ray tubes used in this apparatus are usually composed of tungsten-rhenium alloy on a molybdenum substrate. Since the targets must have substantial thermal capacity they may have a diameter of about 5" (12.7 cm) and such thickness as to create a radial force of over 5 lbs. (2.27 kg) on the front ball bearing of the tube. The target is mounted on the free end of a stem whose other end is fixed to the rotor so there is a substantial cantilever force as well as radial force applied to the front bearing in particular. In computed tomography apparatus, the x-ray tube is mounted on a scanner carriage which rotates to cause the tube to orbit around a patient through an angle of 360° or more for making an x-ray scan of a layer in a body. The scanner carriage rotates on a tilting gantry so the scanning plane can be set at an angle of up to 20° from vertical to permit scanning a body layer at an angle. During the era when the x-ray tube described in the cited patent was devised, the time for making a full circle tomographic scan was typically about 8 seconds or a little less. The scanning time in the currently most advanced computed tomography apparatus has been reduced to a little more than 2 seconds. The rotational axis of the x-ray tube anode is parallel to the orbit axis during a scan. When the gantry is tilted, however, gravitational (g) forces acting on the anode of the tube are quite high and the anode and target tend to undergo precession which imposes even greater radial forces on balls of the bearings to thereby increase the stress on the one ball in each bearing in prior designs that took all of the load. It may also be noted that any unbalance in the target, especially, results in adding to the radial load on the balls of the bearings.

Axial preloading of ball bearings has been employed in rotating machinery outside of the x-ray tube field art. In fact, equations and computer programs have been developed for determining the amount of axial preload force required for getting all of the balls in bearings on a common shaft to share the radial load substantially equally. The generally accepted equation for the minimum preload force that is required to obtain load sharing by the balls, states that the preload force is equal to the radial load multiplied by the tangent of the angle which the balls make with the sloping race surfaces. For example, it has been the practice to preload bearings in aircraft turbine engines to assure that the turbine shaft and its blades will remain centered regardless at the rates at which the races and balls of the bearings heat and expand and regardless of the temperature differential between parts of the bearings. In this kind of application, large bearings are used and they are loaded radially until they are rather close to their permissible stress with some margin of safety being allowed. In such applications, and in x-ray tubes as well, excessive radial stress and, particularly, where most of the radial load is transferred from one ball to the other during rotation, loading and unloading a ball near its maximum permissible stress can result in fatigue of the metal balls and fracture or permanent deformation. In any event, if enough axial preloading is used to make sure that the rotating part remains centered and thermally compensated despite the fact that as axial preloading is increased, bearing friction also increases. Even though this is true, tests have shown that the axially preloaded bearings of the present invention wherein the balls make two-point contact with the races there is substantially less friction than in conventional 3-point contacting gothic arch type of bearings races.

SUMMARY OF THE INVENTION

An important feature of the present invention results from the discovery of an apparent paradox which is that in the kinds of bearings that are suitable for rotating anode x-ray tubes, there is a range through which the axial preload force can be increased over preload forces used in the above described patented preloaded x-ray tube design which results in more of the balls in the bearings, especially the balls in the bottom half of the bearings being forced to accept a share of the radial load imposed by the rotor and target of the x-ray tube. Moreover, the balls in the top half accept a share of the axial load. This range of forces starts at a force somewhat above the maximum axial preload force that was permissible in prior x-ray tubes that used bearings in which the balls made 3-point contact with the races and the range is far below the point where the total contact stress between the balls and races starts to rise rapidly and consistently with increasing axial preload force. In other words it has been discovered that for an x-ray tube application there is a preload force range which allows achieving good thermal compensation in the bearings and better load sharing among the balls under all tube operating circumstances. Moreover, as a result of attention being focused on achieving centering of the rotating shaft in ball bearings in most heavy machinery applications, no one was aware that stress at the contact points between the balls and races of the bearings was high when there was low axial preloading and 3-point contact bearings were used and that contact stress actually reduced over a range of increased axial preloading forces when 2-point contact bearings are used as herein disclosed.

In accordance with the invention, in an x-ray tube, a spring that has low vapor pressure at the high temperatures in the evacuated x-ray tube and that maintains its spring force and has no significant thermal creep at high temperatures is used for axial preloading. The spring is made of a super alloy. For example, one suitable super alloy is available commercially under the trade name "Inconel" and another under the trade name "Hastalloy". A spring material that has the desired characteristics is "Inconel X-750, No. 1 temper." It has a yield strength of 74,000 psi at 538 C. It is composed of: 70% nickel; 14 to 17% chromium; 5 to 9% iron, 2.25 to 2.75% titanium; 0.7 to 1.2% columbium; 0.4 to 1.0% aluminum; 1.0% manganese; 0.5% copper; 0.5% silicon; 0.08% carbon; and, 0.01% sulphur.

An additional feature of the invention is that the bearings are constructed so that there is a two-point contact between the balls and races, that is, the balls contact the outer race at only one point and the sloping surface of the inner race ball groove at only one point. The bearings are configured to assure two-point contact at all times, that is, at all tube temperatures and angular orientations of the anode rotational axis. In addition, an unusually high amount of clearance is provided between the balls and races which can be taken up to a large extent as the balls and races get hotter without risk of having the balls bind in the races and without loss of load sharing by the balls.

An additional feature of the new preloaded x-ray tube bearing arrangement is that load sharing by the bearing balls and, hence, the stiffness of the rotating anode shaft is such that the critical speed at which the shaft will go into a wobbling or precessional vibrational mode will occur at a rotational speed which exists only for an instant during rotor acceleration between the lower rotor speeds such as 3600 rpm and the higher speed of about 10,000 rpm.

How the foregoing and other features of the new axially preloaded x-ray tube bearings are achieved will be evident in the ensuing more detailed description of a preferred embodiment of the invention which will now be set forth in reference to the drawings.

DESCRIPTION OF A PREFERRED EMBODIMENT

Figure 1:
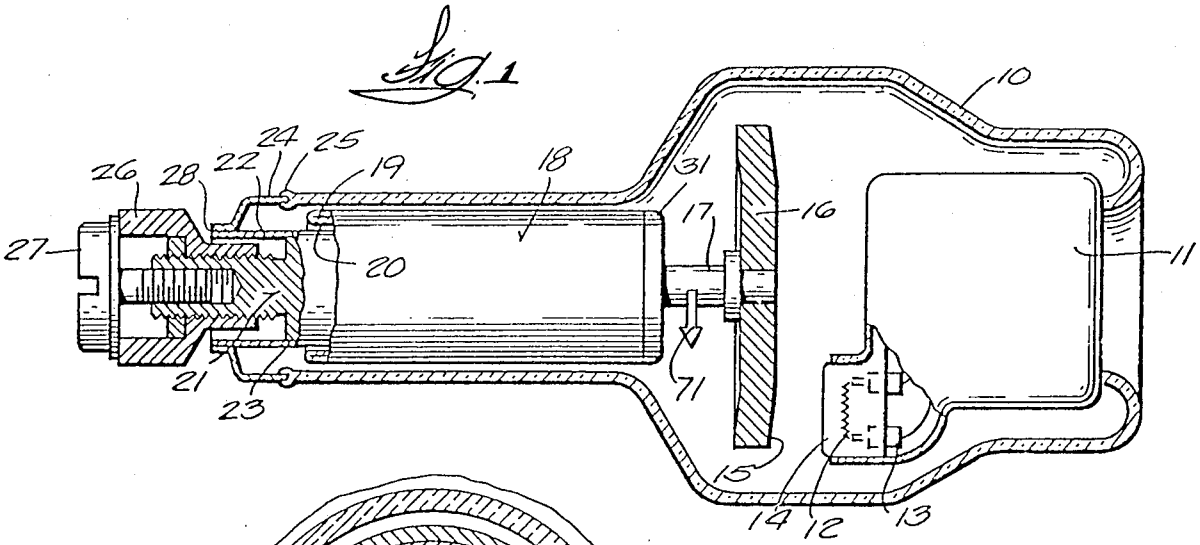
FIG. 1 is a longitudinal sectional view of a rotating anode x-ray tube which embodies the invention and which has some parts broken away to reveal other parts.

FIG. 1 depicts conventional parts of a rotating anode x-ray tube in which the new preloaded bearing arrangement may be employed. The x-ray tube comprises a glass envelope 10 which at one end has a cathode support 11 sealed into it. The electron emissive filament of cathode 12 is mounted on insulators 13 located in a focusing cup 14 which focuses an electron beam against the beveled annular focal track area 15 of the rotating x-ray target 16. Target 16 is supported on a stem 17 that extends from a rotor assembly which is generally designated by the reference numeral 18. A rotating magnetic field is induced in the rotor to cause it to rotate. The field coils for inducing the field are not shown. The rotor comprises an outer sleeve 19, typically of copper laminated to an inner sleeve 20 of ferrous metal.

Figure 2:
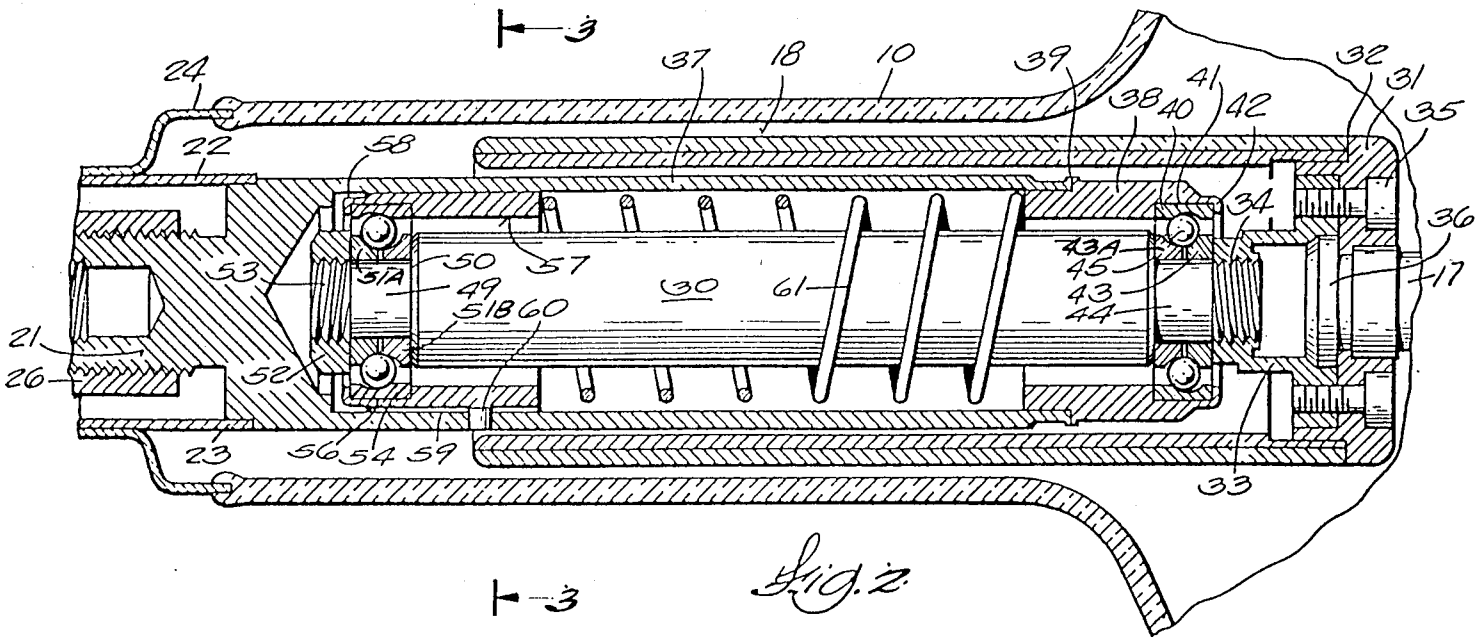
FIG. 2 is an enlarged longitudinal section of the rotating anode assembly isolated from the x-ray tube shown in FIG. 1.

As will be evident in FIG. 2 taken in conjunction with FIG. 1, the rotor is rotatable on a stem 21 which is fixed in the x-ray tube envelope 10. Stem 21 has a tube 22 brazed to it in the region marked 23. One end of metal tube 22 is brazed at 28 to a ferrule 24 which is sealed into the end 25 of tube envelope 10. Stem 21 has a collar 26 screwed or brazed on to it and there is a screw 27 which is used for supporting the tube in its casing, not shown, and for making an electrical connection to it.

Attention is now invited to FIG. 2 which shows that rotor assembly 18 is mounted to a shaft 30. Rotor 18 terminates in an end cap 31 which is brazed to the rotor sleeve in the annular region marked 32. A collar 33 is turned onto the threaded front end 34 of shaft 30. End cap 31 of the rotor assembly is clamped to collar 33 by means of a plurality of inset socket headed screws 35. Shouldered portions 36 of the x-ray target supporting stem 17 are captured between collar 33 and end cap 31.

The main rotor supporting stem 21 has an integral tubular or internally cylindrical portion 37 that is stationary and has a front stationary bearing retainer 38 fastened to it such as by means of TIG welding around the interface marked 39. The outer race 40 of the front ball bearing, which is nearest to the target, is set in the counterbore 41 of bearing retainer 38 and the race 40 is secured in the counterbore by the swaged end 42 on the bearing retainer. The inner race 43 is of the split type and is comprised of two similar rings or sections 43A and 43B which interface at a plane 43G that may be occupied by a shim or its equivalent in accordance with the invention as will be discussed later. The inner race 43 of the front bearing is fitted on a smooth reduced diameter portion 44 of shaft 30 and is retained by collar 33 which is screwed on the shaft. Note that the inner and outer races have outer and inner annular grooves, respectively, in which the bearing balls are arranged in a circle. One part of the inner race groove, of course, is formed in race section 43A and the other part is formed in section 43B.

Figure 3:
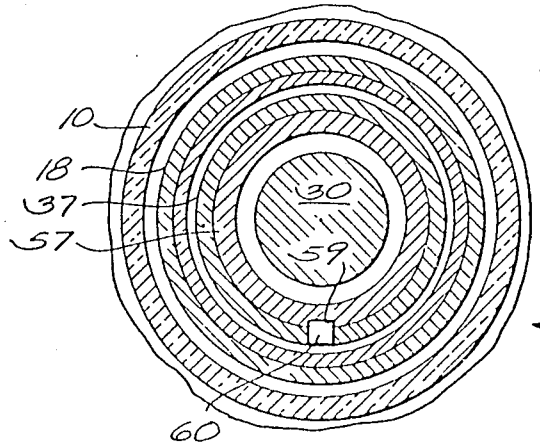
FIG. 3 is a transverse section taken on a line corresponding with 3—3 in FIG. 2.

The rear end of shaft 30 has a reduced diameter portion 49 which defines a shoulder 50. A ball bearing is fitted on portion 49 of the shaft. The inner race of this rear ball bearing is identified by the numeral 51 and is also comprised of two axially separate sections 51A and 51B which interface with each other along a parting plane 51G similar to the front bearing. The inner race 51 is clamped on shaft portion 49 against shoulder 50 by means of a nut 52 which screws onto the thread 53 at the end of shaft 30. The outer race 54 of the rear ball bearing resides in a shouldered counterbore 56 in a bearing retainer tube or sleeve which is generally designated by the numeral 57. Outer race 54 is secured in the shouldered counterbore 56 with the swaged end 58 of rear bearing retainer 57. The rear bearing retainer sleeve fits closely within the bore of stationary tubular stem 37 and the retainer can yield or move axially by a small amount within the bore of stem 38. Retainer 57 has a longitudinally narrow groove 59 on its outer periphery as can be seen in FIGS. 2 and 3. A pin 60 is welded into a suitable opening through tubular stem 37.

The end of the pin extends into axial groove 59 of retainer 57 to prevent the retainer from rotating while still permitting it to move axially.

A preloaded coil spring 61 is interposed between front bearing retainer 38 and axially movable rear bearing retainer 57. This spring reacts against the bearing retainers and imposes a force on the outer races 40 and 54 of the front and rear bearings, respectively, in this particular x-ray tube design. Considering rear bearing 51 generally, one may see that the preloaded spring 61 axial force maintains the outer race in firm contact with the balls of the bearing and the force is further transmitted to the balls to the inner race for maintaining good contact between it and the balls. Since the spring does not rotate and keeps a constant force on retainer 57 which also does not rotate, the constant force is maintained on the bearing balls at all times. There are parallel paths through the front and rear bearings which, under the influence of the mutual reaction of the bearings and the spring, develops substantially equal contact pressure and divide the current flow through the x-ray tube equally.

Figure 4:
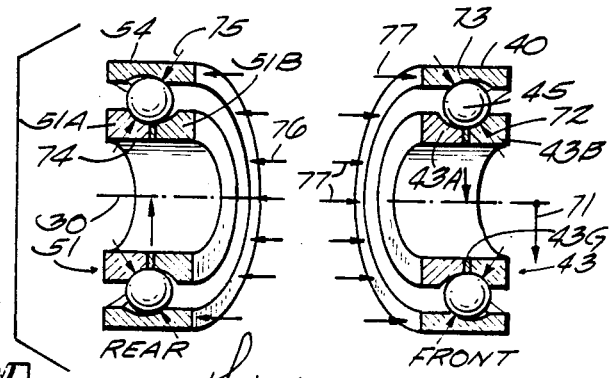
FIG. 4 is a vertical section through the front and rear bearings of the x-ray tube rotating anode structure for explaining the manner in which the bearings in the x-ray tube are loaded.

The structural characteristics of the bearings and the manner in which they are axially preloaded to obtain thermally compensated bearings will now be described in detail. First of all, observe in FIG. 1 that the center of mass of the rotor assembly and x-ray target 16 is located on the target supporting stem 17 and is acted upon by the force of gravity in the direction of the arrow marked 71. Now refer to FIG. 4 which shows a vertical section through the front bearing 43 on the right and the rear bearing 51 on the left. The rotor and target center of mass is acted on by gravity in the direction of the arrow 71 as in FIG. 1. A force couple acting in a vertical plane is developed along the axis of the rotor shaft which is marked 30. In the front bearing 43 there is a reactive force between balls 45 and one-half of the inner race 43B. This reactive force is indicated by the arrow marked 72. There is a diametrically opposite reactive force on the outer race 40 and it is indicated by the arrow marked 73. The reactive forces are not vertical because of the particular configuration of the bearing races as will be discussed in greater detail shortly hereinafter. In the rear bearing in FIG. 4, the reactive forces between the balls and one-half of the inner race 51A and the outer race 54 are indicated by the arrows marked 74 and 75. The axial preload force developed by preloaded spring 61 which acts on the outer races 40 and 54 of the bearings is indicated by the plurality of oppositely directed arrows 76 and 77. As will be evident in FIG. 4, the bearings are loaded by radial and axial forces.

Figure 5:
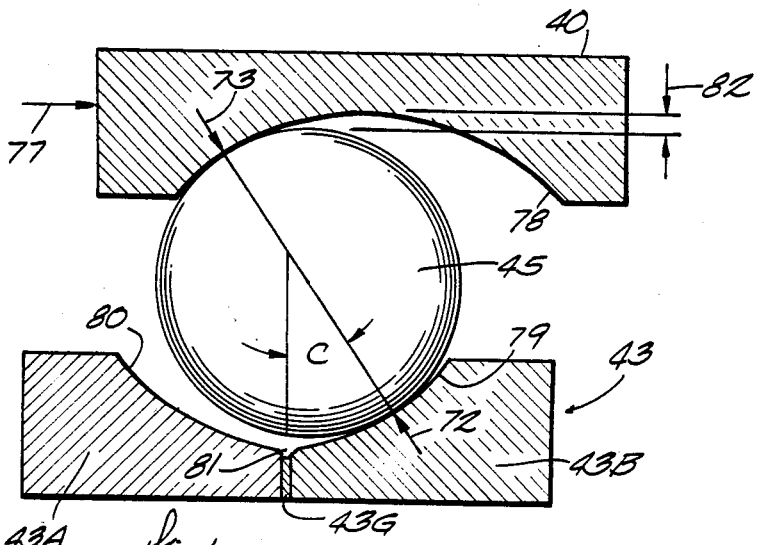
FIG. 5 is a magnified vertical cross-section through the inner and outer race of the front bearing of a rotary anode x-ray tube in which the new bearing structure is employed.

Attention is now invited to FIG. 5 which is an enlarged vertical section through one-half of the front bearing 43 but is exemplary of the configuration and force distribution of both the front and rear bearings. The axial preload force provided by spring 61 acts on outer race 40 in the direction indicated by the arrow marked 77. The ball groove in outer race 40 is a segment of a circle and is marked 78. Ball 45 makes tangential contact with groove 78 in outer race 40 where the reactive force developed by the outer race is indicated at the point of the arrow 73. Balls 45 make tangential contact with the curved inner race ball groove surface 79 at the tip of the arrow 72 which is indicative of the reactive force developed by inner race ring 43B. Thus, in accordance with the invention, the respective bearing balls 45 make two-point contact, one point on inner race surface 79 and one point on outer race surface 78. The grooved surfaces 79 and 80, as has been mentioned earlier, together form in cross-section the so-called gothic arch configuration. Inner races grooves 79 and 80 are developed by a method equivalent to machining a curved groove, comparable to groove 78 in the outer race and then taking a diametrical slice through the center of the groove and moving the two remaining rings 43A and 43B toward each other so they interface where a shim 43G has been inserted between the two inner race sections. The shim is narrower than the slice of material that has been removed between the inner race sections 43A and 43B to preserve the gothic arch configuration. In reality, the top of the space 81 which is occupied by shim 43G could be flat where it bridges between surfaces 79 and 80. In other words, the inner race groove comprised of surfaces 79, 81 and 80 could be machined continuously such that the shim could be eliminated. In any event, the purpose of the configuration is to assure that balls 45 never come into contact with the surface 80 on inner race bearing section 43A so two-point ball contact is preserved under all conditions of thermal and radial and axial loading of the bearings. In FIG. 5, the contact angle of the balls 45 with respect to the races is marked C.

As mentioned earlier, the surface of balls 45 and the outer and inner race surfaces 78, 79 and 80 are coated with silver which acts as the bearing lubricant as is commonly used in the high vacuum and high temperature environment of a rotary anode x-ray tube. In FIG. 5, the clearance between the balls 45 and races is measured between the horizontal lines to which the arrow 82 points. By way of example, in the prior art preloaded bearing design disclosed in U.S. Pat. No. 4,272,696 where there was three-point contact between the balls and races, this clearance was at a maximum of 0.0015" or 1.5 mils. In accordance with the invention, the clearance is increased markedly and, by way of example and not limitation, in a bearing of a size that is commonly used by x-ray tube manufacturers, a clearance of 0.003" or 3 mils is used. Because of the two-point contact and axial preloading in the bearings disclosed herein, when the balls and races expand differentially due to heating when the x-ray tube is under electrical load, the points of contact 72 and 73 between the balls and races simply shift in opposite directions along the races 79 and 78, respectively, to accommodate the difference in the distance between races that results from thermal expansion. The clearance 82 that exists in the new bearing structure when it is cold is chosen so that at maximum bearing temperature a contact point or zone 72 of the balls and the inner race surface 79 never shifts so far that it is at the zone 81. Thus, in reality, inner race section 43A could be removed insofar as bearing operation is concerned but it is kept as a safety retainer. The radial load on the bearings tends to make the balls go down and bottom out along the inner race groove 79, but the relatively strong axial force in the direction of arrow 77 provided by spring 61 prevents this and maintains two-point contact between any ball and the races.

One advantage of being able to use a larger clearance 82 is that, if any of the silver lubricant flakes off, the flake will not cause binding between the balls and races since the balls can shift in the two-point contact mode. Rolling friction is also reduced in the two-point contact structure of the more heavily preloaded bearing in accordance with the invention as compared with a three-point contact scheme used in prior art x-ray tube bearings. The reason for the greater friction in the prior art bearings is that balls cannot roll on three-points when the points are at different distances from the rotational axis of the shaft in which case one of the contact points has to slip or drag and thereby accelerate wear.

In the prior art three-point contact bearing where relatively low axial preloading force was used, it was discovered that the lowermost ball in the front bearing and the uppermost ball in the rear bearing were the only balls that shared oppositely directed radial load forces. In a bearing constructed in accordance with FIG. 5, the heavier preload force and the two-point contact arrangement forces all of the balls into contact with the inner and outer race surfaces 79 and 78 regardless of the attitude of the rotational axis of the tube rotor, but not all of the balls must share radial load equally although they will share the axially preload force equally. Now, the more intense axial preload force increases the total load on the bearings but since it is divided among all the balls of the bearing the net contact point stress on any one ball is actually reduced. In the prior art design, when one ball at a time had all of the radial load applied to it and relieved from it cyclically the one ball became more vulnerable to fatigue failure because of its cyclic flexing. Where the radial load on the balls is shared by a greater number of balls on both sides of the lowermost ball as in the present invention, the cyclically applied radial force which could cause fatigue in the balls as well as in the race groove surfaces is greatly reduced.

In x-ray tubes, the maximum radial load and, hence, opposite reactive forces on the bearing races occurs in the front bearing because of its proximity to the relatively heavy x-ray target 16 which loads the bearing radially and in cantilever fashion. In tubes that use the heaviest targets such as tubes employed in computed tomography scanning the radial loading on the front bearing might be roughly about 6 lbs. Bearing manufacturers consider this to be a rather trivial radial load for bearings of the size that are used in rotating anode x-ray tubes. It is the high temperature differential between inner and outer races of the bearings in x-ray tubes that makes full thermal compensation of these bearings desirable.

In most machines where axial preloading of bearings is employed, the objective is to force the bearing balls into equal radial distances from the center of shaft rotation to maintain the shaft centered at all times. It is known that in such machine designs, total bearing friction increased substantially with preloading force but a lesser force could not be used if the objective of keeping the shaft stiff and centered was to be met. Thus, others skilled in the x-ray tube art perceived that if x-ray tube bearings were preloaded axially by a substantial amount, total bearing friction would increase and, hence, the likelihood of destructive bearing temperatures occurring would increase. The present invention manifests the discovery that there is a range of axial preloading forces wherein contact stress between the balls and races in actually lower than for lower and higher preloading forces. This discovery is demonstrated in FIG. 6. Here one may see that with a limited axial preloading force in the range of one to approximately three pounds contact stress is greater than 150,000 psi. Applicants, however, showed that if the axial preload force is increased above three of a little more pounds that contact stress actually decreases because this results in more of the balls getting a share of the radial load in bearings wherein the balls make contact at two points with the bearing races. Somewhere above ten pounds of axial preload force, there is a continuous increase in contact stress but this is not the preload force range employed in x-ray tube bearings following the thermal compensation concepts disclosed herein. In x-ray tubes made in accordance with the invention, an axial preload force in the range of six to nine pounds is used. In a heavy duty tube having load rating suitable for computed tomography applications, a nominal preload force of eight pounds was used.

Figure 6:
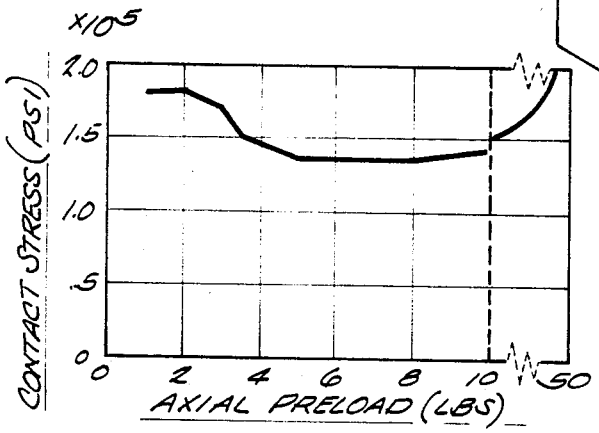
FIG. 6 is a plot of total axial preload force on the bearing races versus the contact stress between the balls and races.
Figure 7:
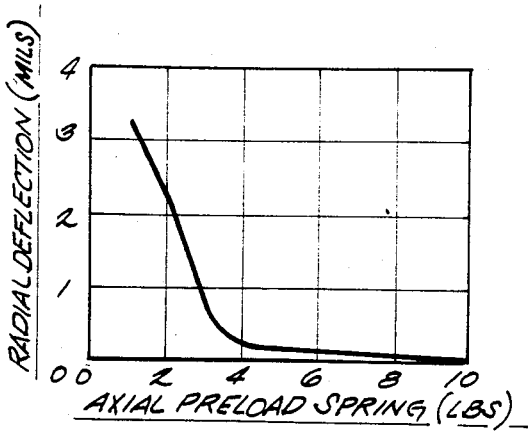
FIG. 7 is a graph showing the relationship between the axial preload spring force and radial deflection of the anode rotor shaft and bearings.

The relatively high axial preload spring force, besides forcing the bearing balls to share the radial load, has an effect on the amount by which the rotor shaft 30 and front and rear bearings deflect under the influence of radial loading. FIG. 7 shows that relationship between axial preload and radial deflection. Note that with axial preload in excess of 2.5 or 3 lbs. in accordance with the invention, radial deflection or bearing stiffness is improved considerably. Stiffness is defined as the amount of radial deflection per unit of radial force. If the bearings are not sufficiently stiff the rotor might precess and bounce at certain speeds. These speeds are called the critical speeds where the amplitude of vibration becomes very large. This is usually due to bending of the shaft and deflection of the bearings. There is always at least one or a first critical speed where the rotor begins to precess or wobble about the bearing axis. Different x-ray procedures require rotating the x-ray target 16 at 3600 and 10,800 rpm approximately where the rotor field coils are energized at 60 Hz or 180 Hz. The two speeds are proportionately lower where power line frequency is 50 Hz or is tripled to 150 Hz. In any case, the design should be such that the critical speed is substantially different than any one of the running speeds. In accordance with the invention, an axial preload force is chosen which results in the bearings and shaft having such stiffness that the critical speed occurs between and at a substantial difference from either of the running speeds. In the typical relationship for x-ray tubes with axial preloading of the bearings and two-point contacting bearings, one may see in FIG. 7 that by exceeding an axial preload force of a little more than four pounds, radial deflection is thereafter quite constant and minimized. In an actual x-ray tube embodiment wherein an axial preload of eight pounds is within the minimum contact stress range as shown in FIG. 6, the same eight pounds is satisfactory for minimizing radial deflection as shown in FIG. 7. As has been indicated earlier, it is known that the minimum axial preload force required for pressing the balls into the races with sufficient force to simply keep the shaft centered is determined by multiplying the radial force by the tangent of the contact angle C specified in FIG. 5. In the actual embodiment mentioned earlier, the approximately eight pounds axial preload force results in a contact angle C of about 27°.

In summary, an x-ray tube has been described wherein corresponding races of the front and rear rotor bearings are axially preloaded by an amount sufficient to maintain each bearing ball in two-point contact with the inner and outer race grooves for whatever radial load is imposed on the bearings by the rotor. Because the points of contact can shift by a small amount without loss of contact because of the axial force that is always present, the original or cold clearance between the balls and races can be much higher than in prior art x-ray tube bearings that utilize the three-point contact concept. Although total axial force on the bearings is increased by using a forceful preloading spring, the stress in the balls and races at their contact points is actually reduced because the total axial and radial forces are now distributed or shared among the balls instead of only one ball as in prior art x-ray tube bearings under radial load. The fact that contact stress in the bearings is actually reduced when the axial preload force is above a certain minimum which continues over a fairly wide range of preload forces, has been demonstrated. It has also been shown that the clearance between races and balls can be made quite great when there is adequate axial preloading which, among other advantages, prevents the bearing jamming or binding in the event silver chips off the bearing races or balls and wedges into the space between the balls and races. The net result of the combination of features is a bearing that is stable and thermally compensated for all temperatures which the bearings are able to obtain in an operating rotating anode x-ray tube. A significant result of the thermal compensation features is that, despite large bearing clearance, no radial free play ever develops in the bearing so the focal spot on the x-ray tube target remains in a fixed position which is advantageous for obtaining sharply defined x-ray images.

We claim:

1. A rotating anode x-ray tube in which the bearings are thermally compensated, said tube comprising an envelope, a shaft in the envelope, an elongated rotor member concentric to the shaft for being driven rotationally about the axis of the shaft, an x-ray target mounted at the front end of the rotor member for rotation with it, front and rear axially spaced apart ball bearings comprised of inner and outer races each of which has a curved groove opposed to the other and plurality of balls between the grooves, said bearings being mounted on the shaft to support the rotor member for rotation, and preloaded spring means arranged to apply force to selected corresponding races of said bearings in opposite axial directions, and the improvement of minimizing the contact stress between each ball and the races on which they run by using a preloaded spring providing said axial force in a range of forces next above the lesser forces that would result in one or fewer than all balls in the bearings carrying the radial load of said rotor member and target, said axial force being great enough to force all balls into contact with the grooves in the races so the balls share the radial load and thereby each develop lower contact stress with the surfaces of the grooves in the races, having the radius of curvature of the surfaces of the grooves in the outer and inner races greater than the radius of the balls and having enough clearance between the balls and groove surfaces so that at any operating temperature when said selected race is shifted axially by the preload force its groove surface will contact the balls at one point on one side of a plane transverse to the shaft axis and the groove surface in the other race will contact said balls at one point on the other side of said plane, the surface of said groove in said inner race being comprised of two curved surfaces having equal radii in effect originating from points along a line parallel to the shaft axis and said surfaces being arranged next to each other with an uncurved section between them to define a nominally gothic arch configuration, said balls normally contacting the one of the two curved surfaces that is most remote from the place on the race where the axial preload force is applied, said uncurved section assuring that said balls will not bottom out on intermediate of said two curved surfaces.

2. The x-ray tube according to claim 1 wherein the total axial preload force provided by said spring is in the range of 5 to 9 pounds.

3. The x-ray tube according to claim 1 wherein the total axial preload force provided by said spring is about 8 pounds.

4. The x-ray tube according to claim 1 wherein said clearance between the balls and races is determined by the axial width of said uncurved section.

5. The x-ray tube according to claim 1 wherein said clearance between the balls and races is at least 0.003 inches.

6. The x-ray tube according to any of claims 1, 2, 3, 4 or 5 wherein said preloaded spring is composed of a metal that has high vapor pressure at a temperature of at least 550° C. and maintains a substantially constant spring force and has low creep over a range of temperatures, up to at least 550° C.

7. The x-ray tube according to any of claims 1, 2, 3, 4 or 5 wherein said spring is composed of an alloy consisting substantially of: 70% nickel; 14 to 17% chromium; 5 to 9% iron; 2.25 to 2.75% titanium; 0.7 to 1.2% columbium and tantalum; 1% manganese; 0.4 to 1% aluminum; 0.5% silicon; 0.5% copper; 0.08% carbon; and, 0.01% sulphur.

* * * * *